US005660717A

United States Patent [19]

Lindemuth

[11] Patent Number: 5,660,717

[45] Date of Patent: Aug. 26, 1997

[54] ABATEMENT OF HYDROLYZABLE CATIONS IN CRUDE OIL

[75] Inventor: Paul M. Lindemuth, Sugar Land, Tex.

[73] Assignee: Nalco/Exxon Energy Chemicals, L. P., Sugarland, Tex.

[21] Appl. No.: 411,374

[22] Filed: Mar. 27, 1995

[51] Int. Cl.[6] ..... C10G 29/00

[52] U.S. Cl. ..... 208/251 R; 208/47; 208/85; 208/188; 252/328; 252/331; 252/344; 252/358

[58] Field of Search ..... 208/188, 85, 251 R, 208/47; 252/331, 358, 328, 344

[56] References Cited

U.S. PATENT DOCUMENTS

| | | | |
|---|---|---|---|
| 4,141,854 | 2/1979 | Pavilcius et al. | 252/358 |
| 4,175,054 | 11/1979 | Tait et al. | 252/331 |
| 4,457,847 | 7/1984 | Lorenc et al. | 210/698 |
| 4,647,381 | 3/1987 | Fong | 210/701 |
| 4,734,205 | 3/1988 | Jacques et al. | 210/708 |
| 4,853,109 | 8/1989 | Reynolds | 208/252 |
| 4,992,164 | 2/1991 | McCullough et al. | 208/282 |
| 4,992,210 | 2/1991 | Naeger et al. | 252/389.62 |
| 5,045,212 | 9/1991 | Augustin et al. | 210/708 |
| 5,078,858 | 1/1992 | Hart et al. | 208/252 |
| 5,080,779 | 1/1992 | Awbrey et al. | 208/252 |
| 5,100,582 | 3/1992 | Bhattacharyya | 252/340 |
| 5,114,566 | 5/1992 | Naeger et al. | 208/289 |
| 5,143,622 | 9/1992 | Fong et al. | 210/700 |
| 5,180,498 | 1/1993 | Chen et al. | 210/697 |
| 5,242,599 | 9/1993 | Chen et al. | 210/697 |
| 5,256,304 | 10/1993 | Meyer et al. | 210/708 |
| 5,271,847 | 12/1993 | Chen et al. | 210/697 |
| 5,271,863 | 12/1993 | Roling | 252/184 |

FOREIGN PATENT DOCUMENTS 757586 8/1980 U.S.S.R. .

*Primary Examiner*—Walter D. Griffin
*Attorney, Agent, or Firm*—Robert A. Miller; James J. Drake

[57] ABSTRACT

Hydrolyzable cations contained in crude oil are removed from crude oil by treatment of the crude oil with an aqueous solution containing 100 to 5000 ppm of a water soluble anionic polymer containing at least 20 mole percent mer groups from the group consisting of acrylic acid, methacrylic acid, sulfomethylated polyacrylamide, aminomethanephosphonic acid modified acrylic acid and their water soluble alkali metal and ammonium salts. By removing the hydrolyzable cations, corrosion occurring on metal surfaces in contact with the treated oil during subsequent refining is reduced.

7 Claims, No Drawings

ABATEMENT OF HYDROLYZABLE CATIONS IN CRUDE OIL

The first step in crude oil refining is often a so called desalting step. This process involves water washing the crude oil, and subsequently breaking the emulsion that is formed. The process is designed to remove as much sodium, magnesium, and calcium chloride salts as possible in order to render the crude oil less corrosive to processing equipment in subsequent processing steps. Unfortunately, the water wash desalting process generally removes sodium to a much greater extent than the more readily hydrolyzable magnesium and calcium chloride salts.

When crude oils or wash waters containing calcium and magnesium salts are processed at typical crude oil furnace temperatures, gaseous hydrochloric acid is evolved. The hydrochloric acid so formed may cause corrosion problems on the contact surfaces of processing equipment. In order to avoid the evolution of hydrochloric acid, it has become common practice to inject caustic into desalted crude oil so as to precipitate the calcium and magnesium cations contained in the oil as hydroxides while forming less hydrolyzable, but still potentially corrosive sodium chloride. It is estimated that about fifty percent of domestic refiners inject caustic into desalted crude oil.

While helping to remove the more hydrolyzable chloride salts, caustic injection may cause exchanger fouling, furnace coking, furnace tube embrittlement, increased emulsification and foaming, downstream catalyst poisoning, and a reduction in the activity of commonly used refinery antifoulant additives.

Other methods have been utilized in an attempt to minimize the effect of the hydrolysis of calcium and magnesium chloride salts in the refining of crude oil. U.S. Pat. No. 4,833,109 to Reynolds discloses the use of dibasic carboxylic acids, and particularly oxalic acid for the removal of divalent metals including calcium and iron. U.S. Pat. No. 5,271,863 teaches the use of a mannich reaction product to extract soluble iron and other divalent metal napthenate salts from crude oils. The preferred mannich reaction product utilized by the patentee is 3-methoxypropylamine-N-(-2'-hydroxy-5-methylphenylacetic acid) 3-methoxypropylamine salt. U.S. Pat. Nos. 5,114,566 and 4,992,210 teach the removal of corrosive contaminants from crude oil by adding a composition including certain organic amines having a pKb of from 2 to 6 and potassium hydroxide to the desalter washwater. The composition is stated to effectively remove chlorides from the crude oil at the desalter. U.S. Pat. No. 5,078,858 suggests the addition of a chelant selected from the group consisting of oxalic or citric acid to the desalter wash water. Likewise, U.S. Pat. No. 4,992,164 also suggests the addition of a chelant, particularly nitrilotriacetic acid, to desalter wash water. U.S. Pat. No. 5,256,304 is directed to the addition of a polymeric tannin material to oily waste water to demulsify oil and flocculate metal ions. U.S. Pat. No. 5,080,779 teaches the use of a chelant in a two stage desalter process for the removal of iron.

While these methods have added technical knowledge to the art, the fact that caustic injection, with its inherent disadvantages continues to be practiced indicates that an improved method for the removal of hydrolyzable chloride salts from crude oil is needed.

It is therefore an object of this invention to provide to the art an improved method for the removal of hydrolyzable cation chloride salts from crude oil in a desalting process. Further objects will appear hereinafter.

BRIEF DESCRIPTION OF THE INVENTION

This invention is directed to the use of certain water soluble polymers as additives to desalter wash water. The polymers serve to disrupt divalent cation stabilized molecular association structures thereby improving the separation of oil from the wash water and additionally aid in the removal of hydrolyzable metal cation chloride salts. The polymers of this invention lead to a process in which caustic injection can be avoided, and in which enhanced calcium and magnesium chloride salt removal from crude oil can be achieved without the addition of materials that could be deleterious to downstream catalyst beds, equipment, or finished products.

DETAILED DESCRIPTION OF THE INVENTION

As stated above, this invention is directed to a method for reducing corrosion on the metallic surfaces of refinery processing equipment in contact with crude oil or its vapor during the refining of such crude oil which generally comprises the steps of:

a. Mixing crude oil containing hydrolyzable metal cation chloride salts with water containing 100 to 5000 ppm of a water soluble anionically charged vinyl addition polymer and preferably a polymer containing at least 20 mole percent of mer units selected from the group consisting of acrylic acid, methacrylic acid, sulfomethylated polyacrylamide, and aminomethanephosphonic acid modified acrylic acid and their respective alkali metal and ammonium salts to form a mixture of crude oil and water;

b. Separating the crude oil from the water;

c. Recovering crude oil containing a reduced level of hydrolyzable metal cation chloride salts and water containing an increased level of hydrolyzable metal cation chloride salts; and then, d. Refining the thus recovered crude oil whereby the corrosion occurring on metal surfaces of the refinery processing equipment in contact with the thus treated crude oil or its vapor is reduced.

The water soluble polymers useful as additives to desalter wash water in accordance with this invention fall within a wide class. The polymers may however be broadly classified as being non-ionic or anionically charged materials. The polymers may have molecular weights ranging from as low as 5,000 to as high as 20–30,000,000 or more, so long as the resultant polymer retains water solubility. Preferably, polymers used in this invention will have molecular weights ranging from as low as about 10,000 to as high as 1,000,000, and most preferably have molecular weight ranges of from 12,000 to about 250,000.

In general, the polymers are based on acrylic acid or its water soluble alkali metal or ammonium salts. In general the polymers of this invention will have at least 20 and preferably 40 mole percent acrylate functionality. Most preferably, the polymers will contain at least 60 mole percent acrylate functionality. As used herein the term acrylate is meant to include acrylic acid, methacrylic acid, and their water soluble alkali metal and ammonium salts.

The polymers of this invention may accordingly be homopolymers of acrylic acid or methacrylic acid, or may be copolymers of acrylic or methacrylic acid with, for example non-ionic vinyl monomers such as acrylamide, lower alkyl esters of acrylic or methacrylic acid, N-vinylformamide, vinyl acetate, vinyl alcohol, or derivatized acrylamides having phosphate or sulfonate functionality such as those described in U.S. Pat. Nos. 4,490,308; 4,546,156; 4,604,431; 4,647,381; 4,676,911; 4,678,840; 4,680,339; 4,703,092; 4,777,894; 4,777,219; 4,801,388; 4,997,890; 5,004,786; 5,120,797; 5,143,622; and 5,179,173 all to Fong et al.

Polymers useful as dispersants and chelating agents for boiler waters such as those described in U.S. Pat. No. 4,457,847, the disclosure of which is hereinafter incorporated by reference into this specification may also be employed as useful additives to desalter wash waters for the control of hydrolyzable cations.

Other water soluble polymers which have been stated to be useful boiler water additives such as those described in U.S. Pat. Nos. 5,180,498; 5,271,847; and 5,242,599, the disclosures of which are hereinafter incorporated by reference into this specification, may also be useful in the practice of this invention.

The polymers of this invention are used at a level of from 100 to 5000 ppm based on the volume of the wash water. Preferably the polymers are used at a level of from 300 to 600 ppm based on the volume of the wash water. The additives of this invention are typically added to the wash water prior to its contacting the crude oil, or, alternatively, may be added, with mixing to the wash water/crude oil mixture. The additives of the invention are characterized as helping to resolve the fraction of water-in-oil emulsion droplets that are highly concentrated in divalent cations, as contrasted to certain conventional chelating agents which are believed to contribute to the formation of a portion of unresolved emulsion located near the bulk oil-water interface, sometimes called "rag".

Several materials to be tested in the method of the subject invention were obtained from commercial sources or synthesized. Two samples of polyacrylic acid modified with aminomethanephosphonic acid were prepared. One of these materials was prepared from a starting material of polyacrylic acid having a molecular weight of approximately 5500. Aminomethanephosphonic acid (32.7 g) was added at room temperature with vigorous stirring to 193.08 g of the polyacrylic acid (45% by weight). Sodium hydroxide (50%) was slowly added in order to raise the pH to 4.2 and to dissolve most of the AMPA. The solution was then sealed inside a high pressure reactor (300 ml Parr Reactor) and heated to 138 C. for eight hours with moderate stirring. A yellow, viscous solution was recovered. NMR analysis indicated that approximately 70% of the AMPA had been incorporated into the polymer backbone as the phosphonomethylamide. This material is hereinafter referred to as sample "K".

The above experiment was repeated using a polyacrylate backbone polymer having a molecular weight of approximately 3200. All other parameters remained the same. This material is hereinafter referred to as sample "I".

The above experiment was repeated using a polyacrylate having a molecular weight of approximately 5,600. All other parameters remained the same. This material is hereinafter referred to as sample "J".

Experiments were conducted whereby various copolymers of acrylamide and acrylic acid were sulfomethylated in accordance with the procedures described and claimed in U.S. Pat. Nos. 5,120,797 and 4,801,388, the disclosures of which are hereinafter incorporated by reference into this specification.

A material identified herein as sample "G" was prepared from a starting copolymer having a molecular weight of approximately 6,500. It was estimated to have approximately 20 mole percent sulfomethylated groups and contained 36% by weight active polymer.

A material identified herein as sample "H" was prepared from a starting copolymer having a molecular weight of approximately 18,000. It was estimated to have 20 mole percent sulfomethylated groups, and contained 36% by weight active polymer.

In order to illustrate the subject matter of this invention, the following experiments were conducted using the following procedure:

a. Synthetic desalter wash water was prepared by preparing a solution containing 0.33 g of calcium chloride and 0.047 g of magnesium chloride per liter of deionized water;

b. 17 ml of the synthetic wash water was added to 325 ml of crude oil;

c. the resultant mixture was mixed for 30 seconds on "stir" setting;

d. 75 ml of emulsion was added to each of 4 100 ml graduated tubes;

e. To each of the two tubes was added 12 ppm of a commercially available emulsion breaker known to have activity in resolving desalter emulsions.

The materials used included Nalco® 5595 (hereinafter emulsion breaker X) Nalco® 5596 (hereinafter emulsion breaker Y), and Nalco® 5599 (hereinafter emulsion breaker Z) each of which is a commercially available ethoxylated nonyl-phenol type emulsion breaker available from Nalco/Exxon Energy Chemicals, L. P., Sugar Land, Tex.;

f. Each of the tubes was capped with electrodes, and was shaken 100 times;

g. The tubes were then placed into a 180 F. portable electric desalter, and a timer started;

h. The tubes were shocked with 3000 volts during the 11th and 12th minutes;

i. The tubes were then removed, and water precipitated after 20, 30, and 40 minutes was recorded.

j. Pipets were used to remove 50 ml aliquots of oil from the top of 2 of the graduated tubes after 40 minutes (one containing each commercial emulsion breaker); and, k. calcium, magnesium and sodium content were determined by inductively coupled argon plasma analysis.

For runs containing the treatment agents of this invention, inductively coupled argon plasma analysis was conducted on the raw crude oil being tested, and the wash water. 0.5 mole of treatment agent indicated per mole of divalent cation contained in the wash water and appropriate mount of crude oil was added to 17 ml of water, and steps b–k above were repeated. Calcium and magnesium removal rates were then calculated against the non-treated samples. Additives utilized are shown in Table I; Results of the above tests are shown in Table II.

TABLE I

| Additive | Description |
|---|---|
| A | aminotri(methylene phosphonic acid) |
| B | 1-hydroxyethylidene 1,1-diphosphonic acid |
| C | hexamethylenediaminetetra(methylenephosphonic acid) hexammonium salt |
| D | ethylenediaminetetraacetic acidescription |
| E | nitrilo-triacetic acid |
| F | polyacrylic acid- 27.7% active, molecular weight approximately 2,500 |
| G | polyacrylic acid- 27.7% active, molecular weight approximately 2,500 |
| H | polyacrylic acid- 27.7% active, molecular weight |

TABLE I-continued

| Additive | Description |
|---|---|
| | approximately 2,500 |
| I | polyacrylic acid- 27.7% active, molecular weight approximately 2,500 |
| J | polyacrylic acid- 27.7% active, molecular weight approximately 2,500 |
| K | polyacrylic acid- 27.7% active, molecular weight approximately 2,500 |

TABLE II

| Experiment | Additive | Emulsion Breaker | $Ca^{+2}$ Removal % | $Mg^{+2}$ Removal % | Total Divalent Cation Removal % |
|---|---|---|---|---|---|
| 1 | A | X | 60 | | |
| 2 | B | X | 5.7 | | |
| 3 | C | X | 39 | | |
| 4 | D | X | 26 | | |
| 5 | E | X | 31 | | |
| 6 | F | X | 30 | | |
| 7 | G | Y | 84 | 52 | 81 |
| 8 | G | Z | 85 | 76 | 83 |
| 9 | H | Y | 54 | 48 | 53 |
| 10 | H | Z | 70 | 45 | 57 |
| 11 | I | Y | 81 | 76 | 80 |
| 12 | I | Z | 75 | 72 | 75 |
| 13 | J | Y | 84 | 83 | 84 |
| 14 | J | Z | 82 | 76 | 80 |
| 15 | K | Y | 64 | 59 | 62 |
| 16 | K | Z | 60 | 55 | 59 |
| 17 | NONE | Y | 28 | 62 | 38 |
| 18 | NONE | Z | 36 | 52 | 40 |

As seen from the results above, the use of the anionic water soluble polymers of the invention allows the removal of substantial calcium and magnesium ions, in turn resulting in less scale attributable to the presence of these hydrolyzable cations. It is also seen that the materials of this invention exhibit improved activity over conventional chelating agents such as materials A–E.

Having thus described and exemplified my invention, I claim:

1. A method for reducing hydrolyzable metal cation caused corrosion in equipment utilized to refine crude oil which comprises the steps of:

a. Mixing crude oil containing hydrolyzable metal cation chloride salts with water containing 100 to 5000 ppm of a water soluble anionically charged vinyl addition polymer selected from the group consisting of sulfomethylated polyacrylamide, polyacrylic acid reacted with aminomethane phosphonic acid and their water soluble alkali metal and ammonium salts;

b. Separating the crude oil from the water to obtain a crude oil; and then, c. Processing said crude oil whereby the crude oil is rendered less corrosive to processing equipment.

2. The method of claim 1 where an oil-in-water emulsion breaker is added to the mixture of crude oil and water to aid in the separation.

3. The method of claim 1 wherein the water soluble vinyl addition polymer has a molecular weight greater than about 6,000.

4. The method of claim 1 wherein the water soluble vinyl addition polymer has a molecular weight in the range of from 5,000 to 100,000.

5. The method of claim 1 wherein the mixture of crude oil in water is resolved in an electrostatic desalting unit.

6. A method for reducing corrosion on the metallic surfaces of refinery processing equipment in contact with crude oil or its vapor during the refining of such crude oil which comprises the steps of:

a. Mixing crude oil containing hydrolyzable metal cation chloride salts with water containing 300 to 600 ppm of a water soluble anionically charged vinyl addition polymer containing at least 20 mole percent of mer units selected from the group consisting of sulfomethylated polyacrylamide, polyacrylic acid reacted with aminomethane phosphonic acid, and their respective alkali metal and ammonium salts to form a mixture of crude oil and water;

b. Separating the crude oil from the water;

c. Recovering the crude oil and water; and then, d. Refining the thus recovered crude oil whereby the corrosion occurring on metal surfaces of the refinery processing equipment in contact with the thus treated crude oil or its vapor is reduced.

7. In a process for the desalting of crude oil of the type wherein crude oil is intimately mixed with an aqueous wash solution, the crude oil is separated from the wash solution, and the crude oil is further processed, the improvement comprising adding to the aqueous wash solution prior to its contact with the crude oil from 100 to 5000 ppm of a water soluble vinyl addition polymer having at least 20 mole percent mer groups from the group consisting of sulfomethylated polyacrylamide, polyacrylic acid reacted with aminomethane phosphonic acid and their water soluble alkali metal and ammonium salts.

* * * * *